US005515633A

United States Patent [19]

Harris

[11] Patent Number: 5,515,633

[45] Date of Patent: May 14, 1996

[54] TRIGGER SHIELD

[76] Inventor: Jon H. Harris, 6073 Airmont Dr., Spring Hill, Fla. 34606

[21] Appl. No.: 431,604

[22] Filed: May 1, 1995

[51] Int. Cl.[6] ..... F41A 17/54

[52] U.S. Cl. ..... 42/70.07

[58] Field of Search ..... 42/70.07, 70.06, 42/70.11

[56] References Cited

U.S. PATENT DOCUMENTS

| | | | |
|---|---|---|---|
| 3,624,945 | 12/1971 | Foote | 42/70.07 |
| 4,499,681 | 8/1985 | Bako et al. | 42/70.07 |
| 5,392,552 | 2/1995 | McCarthy et al. | 42/70.07 |
| 5,437,119 | 8/1995 | Womack | 42/70.07 |

*Primary Examiner*—Stephen M. Johnson
*Attorney, Agent, or Firm*—Joseph C. Mason, Jr.; Ronald E. Smith

[57] ABSTRACT

A trigger shield sandwiches the trigger guard and trigger of a weapon between a base plate and a cover plate to prevent accidental discharge of the weapon. The base plate is slotted and a slide plate is slideably mounted in the slot. A pair of upstanding posts are mounted to the slide plate. A trigger guard is positioned between the upstanding posts when the device is in use. The slideability of the posts enables the structure to accommodate trigger guards of many differing sizes and shapes. A locking device has a ratchet mechanism that enables quick attachment of the cover plate to the base plate, and a safety device prevents inadvertant or accidental release of the locking device. A quick release device enables quick separation of the cover and base plates when access to the trigger of the weapon is required, but the operation of the quick release device is not obvious to a child or other individual unfamiliar with such operation.

3 Claims, 3 Drawing Sheets

TRIGGER SHIELD

BACKGROUND OF THE INVENTION

1. Field of the Invention

This invention relates, generally, to safety devices for weapons such as pistols. More particularly, it relates to devices that prevent a child from pulling the trigger of a weapon.

2. Description of the Prior Art

Weapons usually include a safety device intended to prevent accidental discharge, but accidental discharges of weapons still take many lives per year. Many fatalities occur because weapon owners forget to set the safety mechanism that is provided by the manufacturer of the weapon, and many more occur because the safety is so easily removed from its operable position. Thus, a child playing with a weapon may first accidentally disable the safety, rendering the weapon ready to fire, and then accidentally discharge the weapon.

Thus, there is a need for a life-saying device that prevents a toddler or a child from accidentally discharging a weapon. The device should be removable by an adult who knows how to remove it, but should be difficult if not impossible for a child to remove.

However, in view of the art at the time the present invention was made, it was not obvious to those of ordinary skill how such a device could be provided.

SUMMARY OF THE INVENTION

The longstanding but heretofore unfulfilled need for a safety device that is easy to install but difficult to remove if its method of removal is unknown has now been fulfilled.

The novel device includes a flat base plate positioned in abutting relation to a trigger guard on a first side of a trigger guard, and a pair of upstanding posts mounted to the flat base plate in fixed spaced apart relation to one another. The fixed spaced apart relation is sufficient to receive therebetween a part of the trigger guard.

The device further includes a locking bar mounted in upstanding relation to the base plate in fixed spaced apart relation to the posts, and a flat cover plate positioned in abutting relation to the trigger guard on a second side of the trigger guard. A through aperture is formed in the cover plate for slideably receiving the locking bar, and a quick release locking means is mounted on the cover plate adjacent the through aperture for releasably engaging the locking bar.

The locking bar is positioned between the trigger and the trigger guard and the trigger guard is positioned between the posts when the cover plate is engaged to the base plate.

The base plate, cover plate, and post members collectively engage the trigger guard and bar access to the trigger when the cover plate is engaged to the base plate.

The locking bar is rigid to resist twisting forces applied to the novel device.

It is thus understood that a primary object of the invention is to provide a trigger shield that is easy to install yet not easy for a child to remove.

A more specific object is to provide a trigger shield that may be easily installed and easily and quickly removed by an adult who knows how to perform the removal procedure.

Another important object is to provide a trigger shield that accommodates a large pluarlity of weapons of many different sizes and shapes.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
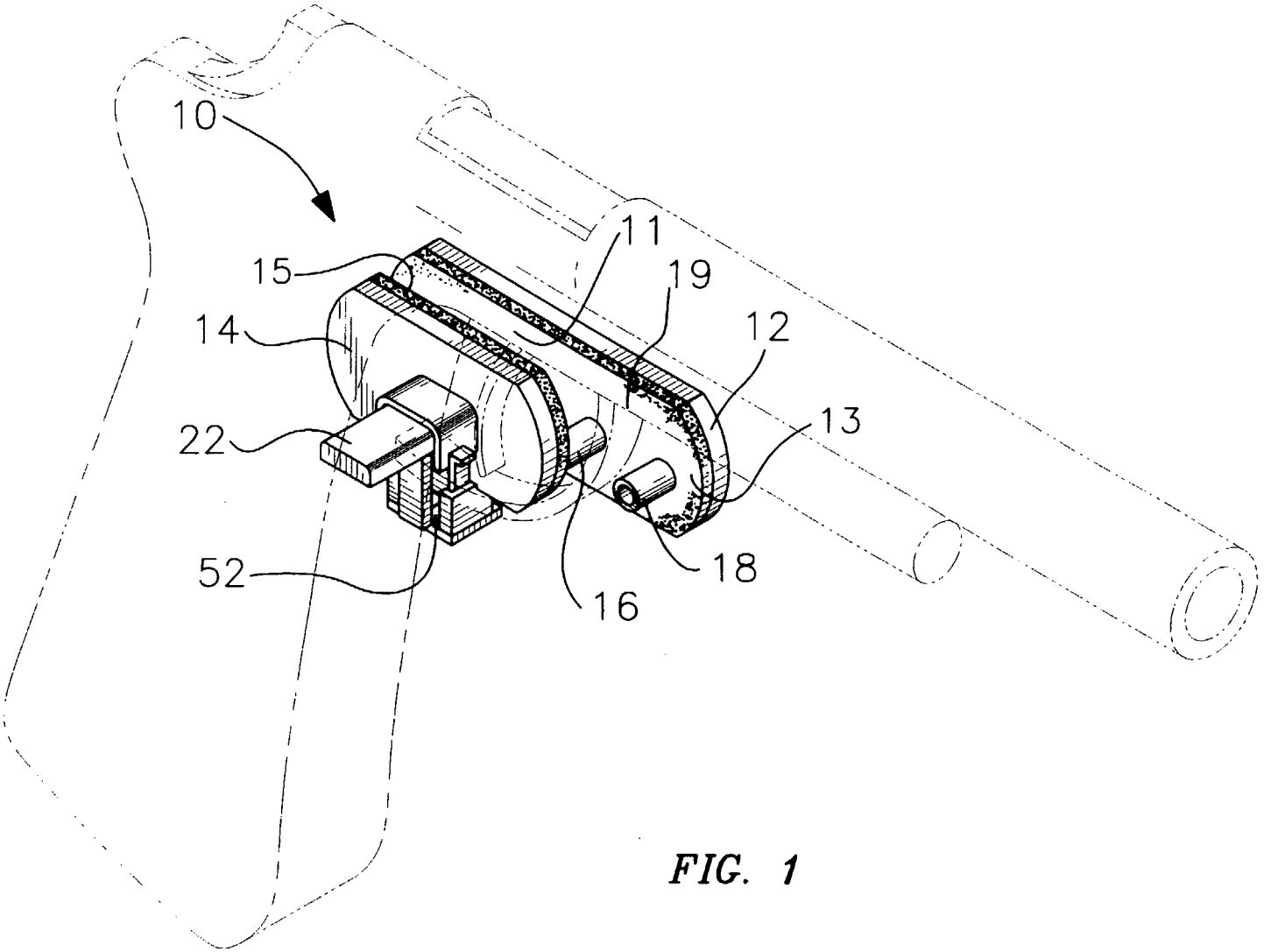
FIG. 1 is a perspective view of a first embodiment of the invention installed on a pistol.

Referring now to FIG. 1, it will there be seen that a first illustrative embodiment of the invention is denoted as a whole by the reference numeral 10.

Trigger shield 10 that guards against inadvertant depression of trigger 11 includes flat base plate 12 and flat cover plate 14. A cushioned pad 13 overlies base plate 12 and a similar pad 15 overlies cover plate 14. A pair of posts 16, 18 are mounted on base plate 12 in upstanding relation thereto and in fixed spatial relation to one another. The amount of spacing therebetween is sufficient to receive a trigger guard 19 as indicated in phantom lines.

Figure 3:
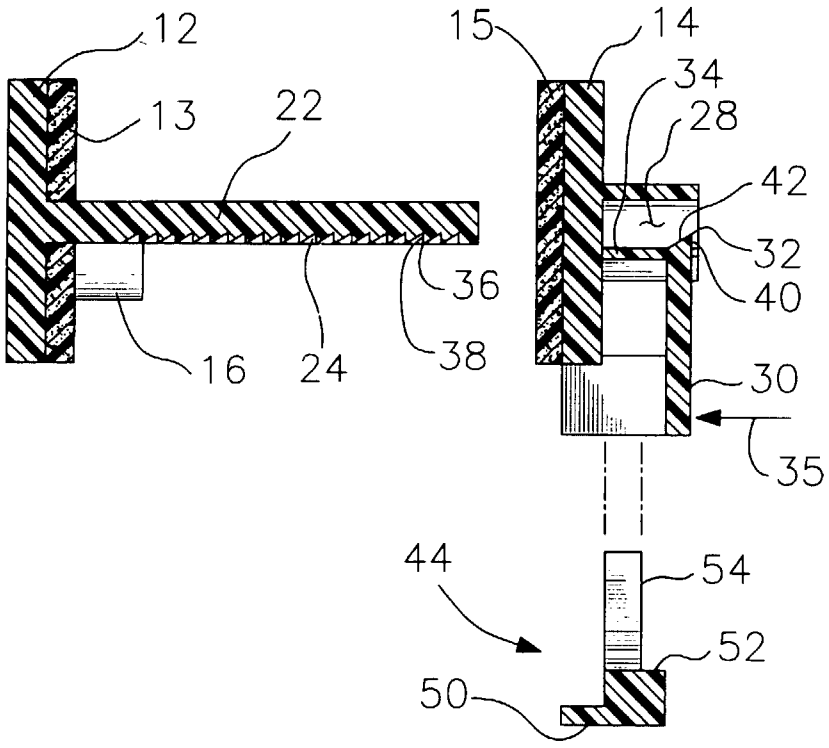
FIG. 3 is a sectional view taken along line 3—3 in FIG. 2.

A rigid locking bar 22 is also fixedly mounted to base plate 12 in upstanding relation thereto, and a plurality of transverse teeth, collectively denoted 24 in FIG. 3, are formed in one side thereof.

Flat cover plate 14 has a through aperture 28 (FIG. 3) formed therein that is shaped and sized to slidingly receive locking bar 22 therethrough. The rigidity of the locking bar resists twisting forces indicated by the double-headed directional arrow 29 in FIG. 2. Thus, flocking bar 22 serves to maintain the depicted alignment between the base and cover plates.

Latch 30 has a leading edge 32 (FIG. 3) that engages a preselected tooth 24 when locking bar 22 extends through aperture 28 and when said latch 30 is in repose as depicted in FIG. 1. Latch 30 is supported near said leading edge by an upstanding support wall 34 (FIG. 3) that is flush with an edge of through aperture 28 as depicted. Thus, depressing the trailing end of latch 30 as indicated by directional arrow 35 in FIGS. 2 and 3 withdraws leading edge 32 from engagement with a tooth 24 so that base plate 12 may be separated from cover plate 14, thereby enabling access to trigger 11.

Each tooth 24 has a top side 36 inclined relative to a vertical plane and a bottom side 38 disposed parallel to the respective planes of the base and cover plates. Leading edge 32 of latch 30 has a top side 40 disposed parallel to the respective bottom sides 38 of said teeth, and a bottom side 42 inclined relative to a vertical plane. The respective angles of inclination of top side 36 of each tooth 24 and of bottom side 42 of latch 30 enable said bottom side 42 to glide over said teeth when base plate 12 and cover plate 14 are displaced toward one another. The parallel disposition of the bottom side 38 of each tooth and the top side 40 of latch leading edge 32, however, prevent divergence of said base and cover plates from one another when said latch 30 is in repose. Thus it is understood that the structure is that of a ratchet mechanism. When a trigger and trigger guard are placed into overlying relation to base plate 12 as depicted in FIG. 1, the ratchet mechanism enables the cover plate to be lowered relative thereto until the trigger and trigger guard are firmly sandwiched between said base and cover plates, but separation thereof is defeated if the trailing end of latch 30 is not depressed as indicated by directional arrow 35 as aforesaid.

The invention also includes a safety device that prevents inadvertant depression of the trailing end of latch 30 and hence quick release of cover plate 14 from base plate 12. The preferred structure of the safety device is a drawer-like structure as denoted generally by the reference numeral 44 in FIGS. 2–4. Safety device 44 includes a pair of side walls 46 mounted to cover plate 14 as depicted, each of said side walls being surmounted by an inwardly extending truncate top wall 48 as best understood in connection with FIG. 2.

Safety device 44 further includes a back plate 50, a stop member 52 formed integrally with said back plate and projecting therefrom in a direction toward said through aperture 28, and a pair of legs 54, also integrally formed with said back plate, said legs being disposed in parallel relation to one another and said legs also extending toward said through aperture.

The transverse spacing between legs 54 is selected so that said legs frictionally engage the interior surfaces of side walls 46. Such frictional engagement enables the sliding advancement or withdrawal of stop member 52 relative to the trailing end of latch 30. When stop member 52 is advanced as depicted in FIG. 1, said trailing end cannot be depressed and the base and cover plates cannot be separated from one another due to the ratchet-like construction that interlocks them. When stop member 52 is retracted, said trailing end of latch 30 can be depressed and said base and cover plates may be separated from one another. If base plate 12 is not supported when said trailing end is depressed, said base plate will fall instantly, i.e. locking bar 22 will drop from aperture 28 under the influence of gravity.

An outwardly directed flange 56 is formed on the free end of each leg 54 to prevent over-retraction of safety device 44.

Figure 2:
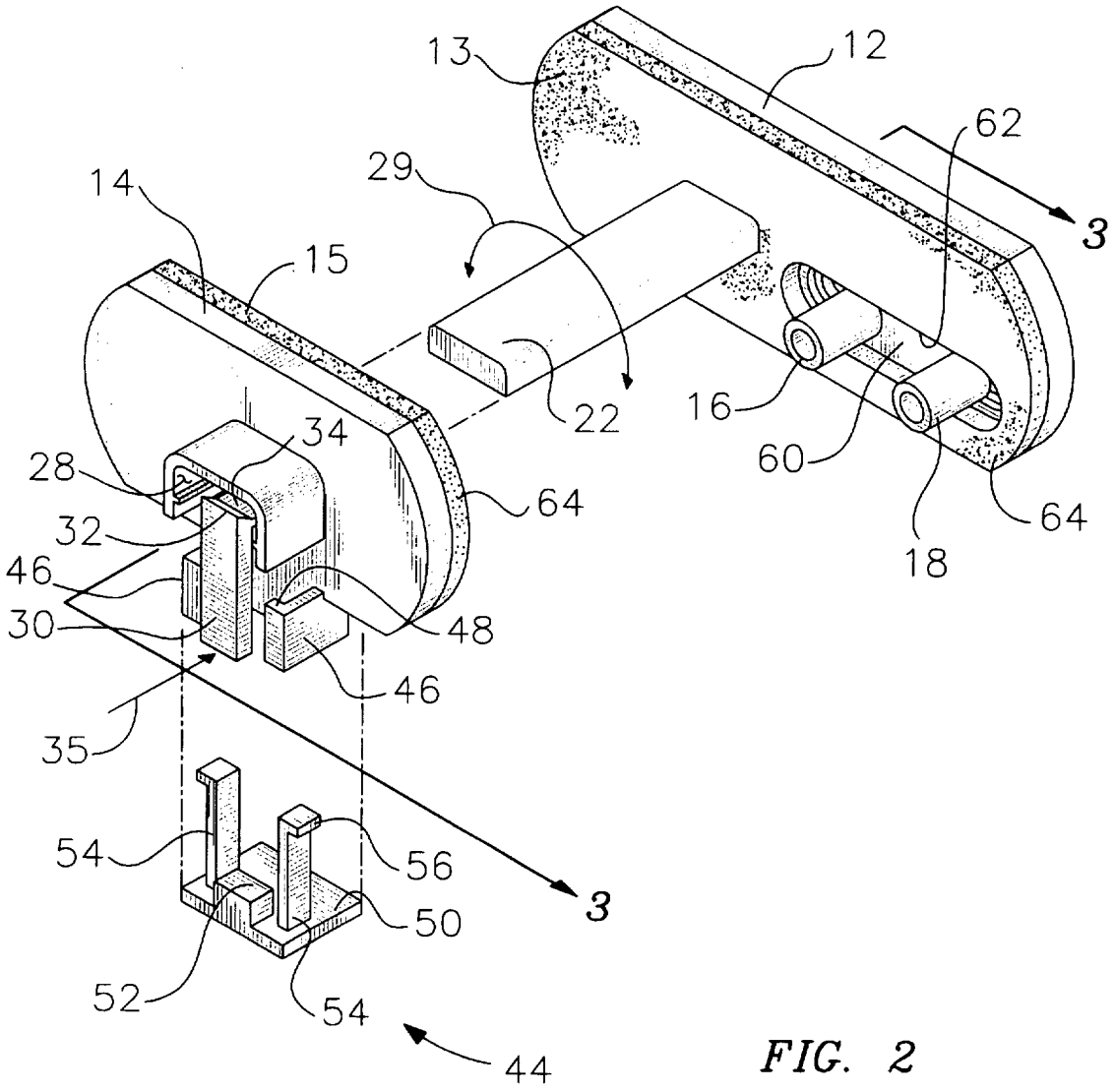
FIG. 2 is a perspective view of a second embodiment in an exploded configuration so that its three main parts are better depicted.
Figure 4:
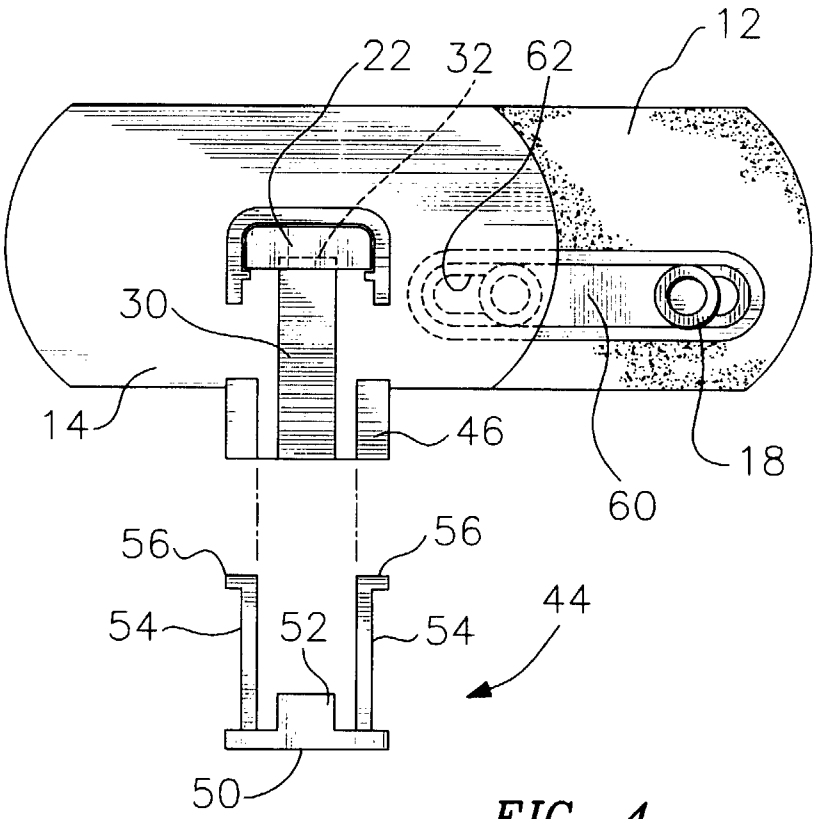
FIG. 4 is a side elevational view of the second embodiment.

An embodiment that fits fire arms having many differing trigger guard and trigger configurations is depicted in FIGS. 2 and 4. In this embodiment, posts 16, 18 are mounted on a slide member 60 that is slideably mounted within a slot 62 formed in base plate 12. This enables the safe storage of fire arms having triggers and trigger guards of differing sizes and configurations.

To use either embodiment, trigger 11 and trigger guard 19 are placed into overlying relation to base plate 12; inner post 16 is disposed on one side of trigger guard 19 and outer post 18 is disposed on the other side of said guard. Locking bar 22 is positioned between trigger 11 and said posts. The through aperture 28 formed in cover plate 14 is then aligned with locking bar 22 and the cover plate is advanced toward the base plate until such advance is stopped by the trigger guard. Drawer 44 is then advanced so that stop member 52 is slid under the trailing end of latch 30 and the weapon may then be safely stored or holstered. To release the safety device from the weapon, drawer 44 and hence stop member 52 are retracted, i.e., stop 52 is slid out from under said trailing end and said trailing end is depressed as indicated by arrow 35 as aforesaid; cover plate 14 may then be removed from base plate 12 and the trigger of the fire arm is no longer shielded by the novel device.

The novel structure provides a trigger shield that is easy to install and easy to remove by an adult familiar with the structure and operation of the shield. However, removal is virtually impossible for a child. Thus, this life-saving invention represents an important contribution to the art of firearm safety devices.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that prevents inadvertant pulling of a trigger, comprising:

a flat base plate for positioning in abutting relation to a trigger guard on a first side of said trigger guard;

a pair of upstanding posts mounted to said flat base plate in fixed spaced apart relation to one another;

a locking bar mounted in upstanding relation to said base plate in fixed spaced apart relation to said posts;

a flat cover plate for positioning in abutting relation to said trigger guard on a second side of said trigger guard;

a through aperture formed in said cover plate for slideably receiving said locking bar;

a quick release locking means mounted on said cover plate adjacent said through aperture for releasably engaging said locking bar;

said locking bar being positioned between said trigger and said trigger guard and said trigger guard being positioned between said posts when said cover plate is engaged to said base plate;

said locking bar being elongate, flat, rigid to resist twisting forces applied to said device, and having a plurality of teeth formed therein along its length;

said quick release means including a latch adapted to engage a preselected tooth of said plurality of teeth, said latch being biased into latching engagement with a preselected tooth so that a manual force is required to disengage said latch from said preselected tooth to enable separation of said base plate and cover plate from one another;

said base plate, cover plate, and post members collectively engaging said trigger guard and barring access to said trigger when said cover plate is engaged to said base plate;

a safety means for preventing inadvertant release of said quick release means;

said safety means including a stop member that is slideably mounted to said cover plate, said stop member being positioned below said latch and preventing depression of said latch when said stop member is in a first, inward position and said stop member being positioned away from said latch and not preventing depression of said latch when said stop member is in a second, outward position.

2. The device of claim 1, further comprising an elongate slot formed in said base plate, a slide member disposed within said elongate slot, said slide member adapted for sliding reciprocation within said elongate slot, and wherein said upstanding posts are mounted to said slide member in fixed spaced apart relation to one another so that said device may be attached to trigger guards of varying sizes upon sliding said slide member within said elongate slot to reposition said posts as required for trigger guards of varying sizes.

3. A locking device that prevents inadvertant pulling of a trigger, comprising:

a flat base plate for positioning in abutting relation to a trigger guard on a first side of said trigger guard;

an elongate slot formed in said flat base plate;

an elongate slide member slideably disposed in said elongate slot;

a pair of upstanding posts mounted to opposite ends of said elongate slide member in fixed spaced apart relation to one another;

a locking bar mounted in upstanding relation to said base plate;

a flat cover plate for positioning in abutting relation to a said trigger guard on a second side of said trigger guard;

a through aperture formed in said flat cover plate for slideably receiving said locking bar; and a quick release locking means mounted on said cover plate adjacent said through aperture for releasably engaging said locking bar;

whereby said base plate, cover plate, and post members collectively capture said trigger therebetween and bar access thereto when said locking device is engaged with said locking bar.

* * * * *